US009360255B2

(12) United States Patent
Eriksson et al.

(10) Patent No.: US 9,360,255 B2
(45) Date of Patent: Jun. 7, 2016

(54) METHOD AND ARRANGEMENT FOR VORTEX REDUCTION IN A METAL MAKING PROCESS

(71) Applicant: ABB Research Ltd., Zurich (CH)

(72) Inventors: Jan-Erik Eriksson, Vasteras (SE); Tord Kroon, Vasteras (SE); Mohamed Ali Rahmani, Vasteras (SE); Ola Widlund, Hagersten (SE); Xiaojing Zhang, Vasteras (SE); Christer Carlsson, Pewaukee, WI (US); Hongliang Yang, Västerås (SE)

(73) Assignee: ABB Research Ltd., Zurich (CH)

( * ) Notice: Subject to any disclaimer, the term of this patent is extended or adjusted under 35 U.S.C. 154(b) by 245 days.

(21) Appl. No.: 14/192,345

(22) Filed: Feb. 27, 2014

(65) Prior Publication Data

US 2014/0175715 A1 Jun. 26, 2014

Related U.S. Application Data

(63) Continuation of application No. PCT/EP2011/064786, filed on Aug. 29, 2011.

(51) Int. Cl.
*F27D 3/15* (2006.01)
*F27B 3/08* (2006.01)
(Continued)

(52) U.S. Cl.
CPC ..... *F27D 3/1518* (2013.01); *B22D 37/00* (2013.01); *B22D 41/08* (2013.01); *C21C 5/4653* (2013.01); *F27B 3/085* (2013.01); *F27B 3/19* (2013.01); *F27D 3/1509* (2013.01); *F27D 27/00* (2013.01)

(58) Field of Classification Search
CPC ..... F27D 27/00; F27D 3/1518
USPC ..... 266/235, 237
See application file for complete search history.

(56) References Cited

U.S. PATENT DOCUMENTS

| | | | | |
|---|---|---|---|---|
| 4,805,669 | A | 2/1989 | Lillicrap | |
| 2009/0120604 | A1 | 5/2009 | Lehman et al. | |
| 2014/0175715 | A1* | 6/2014 | Eriksson | F27B 3/085 266/45 |

FOREIGN PATENT DOCUMENTS

| | | | |
|---|---|---|---|
| DE | 19911607 | A1 | 9/2000 |
| EP | 0192991 | A1 | 9/1986 |

(Continued)

OTHER PUBLICATIONS

The Korean Intellectual Property Office Notice of Grounds for Rejection Application No. 20147008419 Issue Date: Mar. 18, 2015 pp. 5.

(Continued)

*Primary Examiner* — Scott Kastler
(74) *Attorney, Agent, or Firm* — Whitmyer IP Group LLC

(57) ABSTRACT

A method for reducing vortex formation in molten metal when bottom tapping the molten metal from a metallurgical vessel in a metal making process. The method includes the steps of tapping the molten metal via a tapping hole in the metallurgical vessel, and providing a flow of the molten metal in the metallurgical vessel while tapping via a time-varying electromagnetic field applied to the metallurgical vessel, the flow of the molten metal being such that it constantly moves vortices in the molten metal away from a tapping hole region during the tapping to thereby prevent accumulation of the vortices for vortex formation over the tapping hole. It is also presented an arrangement for carrying out the method.

11 Claims, 2 Drawing Sheets

(51) Int. Cl.

| | |
|---|---|
| ***F27B 3/19*** | (2006.01) |
| ***F27D 27/00*** | (2010.01) |
| ***B22D 37/00*** | (2006.01) |
| ***B22D 41/08*** | (2006.01) |
| ***C21C 5/46*** | (2006.01) |

(56) References Cited

FOREIGN PATENT DOCUMENTS

| | | | |
|---|---|---|---|
| EP | 1277531 | A2 | 1/2003 |
| EP | 1514065 | B1 | 3/2005 |
| JP | H0254711 | A | 2/1990 |
| JP | H02219978 | A | 9/1990 |
| JP | H0428460 | A | 1/1992 |
| JP | H05287354 | A | 11/1993 |
| JP | H08168851 | A | 7/1996 |
| KR | 20050064935 | A | 6/2005 |
| WO | 0136130 | A1 | 5/2001 |
| WO | 2006031964 | A1 | 3/2006 |

OTHER PUBLICATIONS

International Preliminary Report on Patentability Application No. PCT/EP2011/064786 Issued: Jan. 10, 2014 17 pages.

International Search Report & Written Opinion of the International Searching Authority Application No. PCT/EP2011/064786 Completed: May 30, 2012; Mailing Date: Jun. 6, 2012 10 pages.

Written Opinion of the International Preliminary Examining Authority Application No. PCT/EP2011/064788 Mailing Date: Aug. 20, 2013 5 pages.

* cited by examiner

METHOD AND ARRANGEMENT FOR VORTEX REDUCTION IN A METAL MAKING PROCESS

FIELD OF THE INVENTION

The present disclosure generally relates to a metal making process and in particular to vortex reduction during tapping operations in the metal making process.

BACKGROUND OF THE INVENTION

In a metal making process molten metal is during various stages of the process tapped from tapping holes of metallurgical vessels such as electric arc furnaces, tundishes or ladles. The molten metal is thereby transported to the next stage in the process.

When tapping the molten metal from a metallurgical vessel, vortex formation normally occurs above the tapping hole. When the vortex is formed, slag on top of the melt is carried over into the next metallurgical vessel below the tapping hole via the vortex. The slag carry-over has detrimental effects on the metal quality.

EP0192991 discloses a method of operating a metallurgical melting furnace whose furnace vessel is provided with at least one tapping opening. According to the disclosure, vortices are counteracted in the melt in the area of the tapping opening by means of an electromagnet generating an electromagnetic field which acts on the melt. The vortex formation is counteracted by controlling the electromagnet such that it produces electromagnetic fields providing a counter rotation relative the vortex flow in the molten metal.

SUMMARY OF THE INVENTION

There are however drawbacks with the above method of generating a counter-rotational motion in the melt by means of an electromagnetic field. It is for instance difficult to determine the rotational speed of the vortex, which is necessary for determining a correct counter-rotational motion in the melt by means of the electromagnetic field.

Moreover, the above-described method is arranged to counteract a vortex which has already been formed in the tapping hole region, but it does not prevent the formation of a vortex in the tapping hole area.

In view of the above, a general object of the present disclosure is to provide a simplified method and arrangement for reducing vortex formation in molten metal during tapping of the molten metal from a metallurgical vessel.

Another object is to provide a method and arrangement for preventing or at least delaying the on-set of vortex formation above the tapping hole during tapping of the molten metal from the metallurgical vessel.

To this end, in a first aspect of the present disclosure, there is provided a method for reducing vortex formation in molten metal when bottom tapping the molten metal from a metallurgical vessel in a metal making process, wherein the method comprises: tapping the molten metal via a tapping hole in the metallurgical vessel; and providing a flow of the molten metal in the metallurgical vessel while tapping by means of a time-varying electromagnetic field applied to the metallurgical vessel, the flow of the molten metal being such that it constantly moves vortices in the molten metal away from a tapping hole region during the tapping to thereby prevent accumulation of the vortices for vortex formation over the tapping hole.

The tapping hole region is herein defined as an area extending axially from the tapping hole, centred around the central axis of the tapping hole, through the metallurgical vessel.

By constantly moving the molten metal such that vortices which naturally arise in the volume of the molten metal constantly move, the vortices are not allowed to accumulate in the tapping hole region, i.e. the region around the central axis of the tapping hole. Thereby vortex formation is prevented or the probability of vortex formation above the tapping hole is at least reduced. Beneficially, by preventing the formation of a vortex above the tapping hole, slag on top of the molten metal will not be carried over into the next metallurgical vessel during tapping operations, and hence the metal quality of the slab, billet, bloom or other metal product may be improved.

The molten metal may for instance be molten steel, molten aluminium or molten copper.

In one embodiment the time-varying electromagnetic field provides a forced convection of the molten metal in the metallurgical vessel. Hence, instead of providing a counter rotational motion of the molten metal as in EP0192991v, the molten metal moves according to a forced convectional motion in the metallurgical vessel during tapping.

In one embodiment the molten metal flow is transverse to a central axis of the tapping hole. In particular, the molten metal flows in a direction transverse to the central axis of the tapping hole at any given depth of the molten metal in the metallurgical vessel. Hence, at substantially any depth in the molten metal above the tapping hole, the molten metal essentially flows perpendicularly in relation to the central axis of the tapping hole. To this end the molten metal flows essentially parallel with the bottom surface of the metallurgical vessel at any depth in the molten metal above the tapping hole. Thus the molten metal flows in such a way that close to the bottom surface of the metallurgical vessel molten metal is pushed to discharge quickly through the tapping hole, while closer to the surface of the molten metal the molten metal is continually carried away from the central axis of the tapping hole, and thus from the tapping hole region. Thereby at any depth above the tapping hole the molten metal is either moved away from the region around the central axis of the tapping hole or pushed through the tapping hole for discharging the molten metal. Thus, vortices are carried away from the tapping hole region, and as a result, vortex formation above the tapping hole is prevented.

In one embodiment the molten metal flows towards a first inner wall portion of the metallurgical vessel at the bottom of the metallurgical vessel and towards a second inner wall portion opposite the first inner wall portion at the surface of the molten metal.

In one embodiment the time-varying electromagnetic field has such strength that a flow rate of the molten metal is in the range 0.1-1 m/s.

In one embodiment the flow rate is in the range 0.1-0.6 m/s. By providing a time-varying electromagnetic field which generates a molten metal flow rate in the range 0.1-0.6 m/s, energy for powering e.g. an electromagnetic stirrer for the generation of the time-varying electromagnetic field can be saved. In particular, the range 0.1-0.6 m/s is a lower flow rate than the flow rate utilised when the electromagnetic stirrer stirs the molten metal during meltdown and stirring of the melt in the metallurgical vessel. Furthermore, the lower flow rate does not disturb the metal mix e.g. steel mix, obtained during for instance the melting process by means of providing additives to the metal and the stirring thereof.

In one embodiment the time-varying electromagnetic field is provided by an electromagnetic stirrer.

According to a second aspect of the present disclosure there is provided an arrangement for a metal making process, the arrangement comprising a metallurgical vessel for accommodating molten metal, the metallurgical vessel having a tapping hole for bottom tapping the molten metal from the metallurgical vessel; and an electromagnetic field emitting device arranged to generate a time-varying electromagnetic field in molten metal arranged in the metallurgical vessel, wherein the electromagnetic field emitting device is arranged to induce a time-varying electromagnetic field in the molten metal during tapping of the molten metal from the metallurgical vessel to thereby generate a flow of the molten metal in the metallurgical vessel, the electromagnetic field being such that the flow constantly moves vortices away from a tapping hole region in the molten metal during the tapping to thereby prevent accumulation of the vortices for vortex formation over the tapping hole.

In one embodiment the electromagnetic field emitting device is an electromagnetic stirrer.

In one embodiment the metallurgical vessel is an electric arc furnace. Alternatively the metallurgical vessel may be a tundish or a ladle.

In one embodiment the time-varying electromagnetic field is such that it provides a forced convection of the molten metal in the metallurgical vessel.

In one embodiment the time-varying electromagnetic field is such that it provides flow of molten metal which transverses a central axis of the tapping hole.

In one embodiment the time-varying electromagnetic field is such that it provides a flow of molten metal towards a first inner wall portion of the metallurgical vessel at the bottom of the metallurgical vessel and towards a second inner wall portion opposite the first inner wall portion at the surface of the molten metal.

In one embodiment the electromagnetic field has such strength that a flow rate of the molten metal is in the range 0.1-1 m/s.

In one embodiment the flow rate is in the range 0.1-0.6 m/s.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The inventive concept will now be described, by way of example, with reference to the accompanying drawings, in which.

DETAILED DESCRIPTION OF THE INVENTION

The inventive concept will now be described more fully hereinafter with reference to the accompanying drawings, in which certain embodiments are shown. It is to be noted, however, that the metallurgical vessel disclosed herein may be embodied in many different forms and should not be construed as limited to the embodiments set forth hereinafter; rather, these embodiments are provided by way of example so that this disclosure will be thorough and complete, and will fully convey the scope of the invention to those skilled in the art. Like numbers refer to like elements throughout the description.

Metallurgical vessels are used in metal production e.g. in steel or metal works. Such metallurgical vessels may for instance be ladles, electric arc furnaces or tundishes. Whenever referred to in the following, a metallurgical vessel is to be understood to mean an electric arc furnace, a ladle, a tundish or any other refractory metallurgical vessel having a tapping hole at its bottom.

Figure 1:
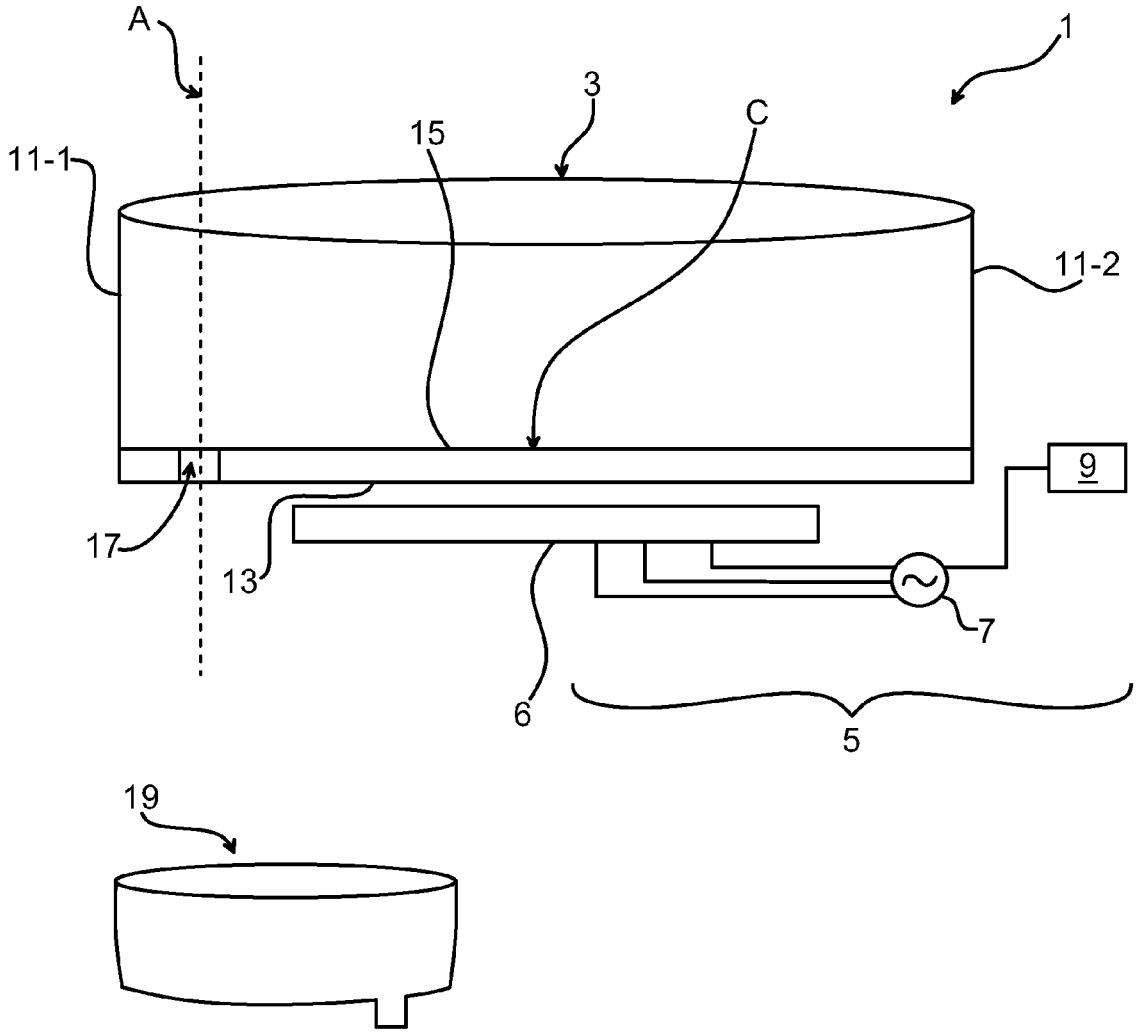
FIG. 1 is a schematic perspective view of an example of an arrangement for metal making.

FIG. 1 shows an arrangement 1 for metal making. The arrangement 1 comprises a metallurgical vessel 3 and an electromagnetic field emitting device, in the following exemplified by an electromagnetic stirrer 5. The electromagnetic stirrer 5 comprises a coil arrangement 6, a frequency converter 7 for operating the coil arrangement 6 and a control unit 9 for controlling the frequency converter 7. The electromagnetic stirrer 5 is arranged below the metallurgical vessel 3. It is however to be noted that, depending on the shape of a metallurgical vessel, the electromagnetic stirrer could also be positioned at one of the sides of the metallurgical vessel.

The metallurgical vessel 3 has walls 11-1 and 11-2 presenting first and a second inner wall portions, respectively. The first and the second inner wall portions are opposite each other. The metallurgical vessel 3 further has a bottom 13 presenting an inner bottom surface 15, and a tapping hole 17 extending through the bottom 13. The tapping hole 17 provides a through opening from the interior of the metallurgical vessel 3 to its exterior. The tapping hole 17 is typically provided off-centre with respect to a centre point C of the bottom surface 15, but a centrally located tapping hole is also envisaged in some embodiments. The tapping hole 17 has a central axis A extending axially through the tapping hole 17.

Whether the metallurgical vessel 3 is arranged to receive scrap or molten metal depends on where in the metal making process the metallurgical vessel 3 is to be used. If the metallurgical vessel 3 is an electric arc furnace, it is arranged to receive scrap for meltdown of the scrap to molten metal. If the metallurgical vessel 3 is a tundish or a ladle it is arranged to receive molten metal for instance from an electric arc furnace. In either case, the molten metal is tapped from the metallurgical vessel 3 through the tapping hole 17 in the bottom 13.

When tapping molten metal from the metallurgical vessel 3, the molten metal is typically tapped into another metallurgical vessel 19.

In cases when the metallurgical vessel 3 is an electric arc furnace, the tapping hole 17 is typically filled with a refractory material such as refractory sand when loaded with scrap for meltdown. As a result, molten metal resulting from the meltdown of the scrap is held within the metallurgical vessel 3 until tapping is desired. When subsequently tapping of the molten metal is to be performed, the refractory material is removed from the tapping hole 17, thereby allowing the molten metal to be tapped from the metallurgical vessel 3 through the tapping hole 17.

The metallurgical vessel 3 may in some variations be pivotable for performing tapping of the molten metal from the metallurgical vessel 3. The metallurgical vessel 3 may for instance be pivotable when embodied as an electric arc furnace. The bottom tapping through the tapping hole can thereby be facilitated.

The principles of vortex formation in a metallurgical vessel will now shortly be described with reference to FIGS. 2*a* and 2*b*.

Figure 2A:
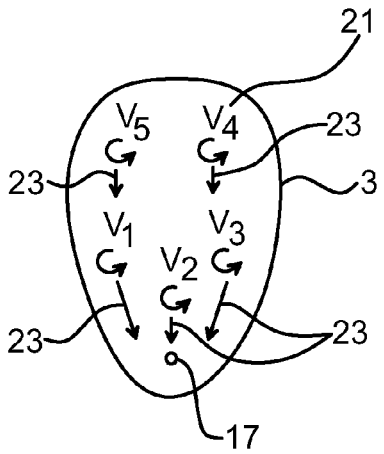
FIG. 2*a* is a top view of a metallurgical vessel in which vortices are formed above a tapping hole during tapping.
Figure 2B:
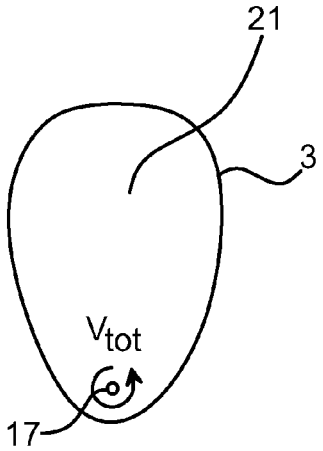
FIG. 2*b* is a top view of a metallurgical vessel in which a vortex has been formed from a plurality of vortices above the tapping hole of the metallurgical vessel.

FIGS. 2*a-b* show top views of the metallurgical vessel 3 accommodating a molten metal 21. The tapping hole 17 is shown in both FIG. 2*a* and FIG. 2*b* to simplify the understanding of the vortex formation process. In reality the molten metal covers the tapping hole 17 and is hence not visible from above.

During tapping of the molten metal 21 from the metallurgical vessel 3 a plurality of vortices such as vortices V1, V2, V3, V4, and V5 are formed in the molten metal 21. The vortices V1, V2, V3, V4, and V5 move towards the tapping hole 17 in the volume of the molten metal 21, as shown by arrows 23.

The vortices V1, V2, V3, V4, and V5 accumulate above the tapping hole in a region around the central axis A of FIG. 1. As illustrated in FIG. 2*b* the accumulated vortices V1, V2, V3, V4, and V5 form a larger vortex $V_{tot}$. The vortex $V_{tot}$ is undesirable as it carries over slag from the surface of the molten metal 21 into e.g. the next metallurgical vessel in the process.

Figure 3:
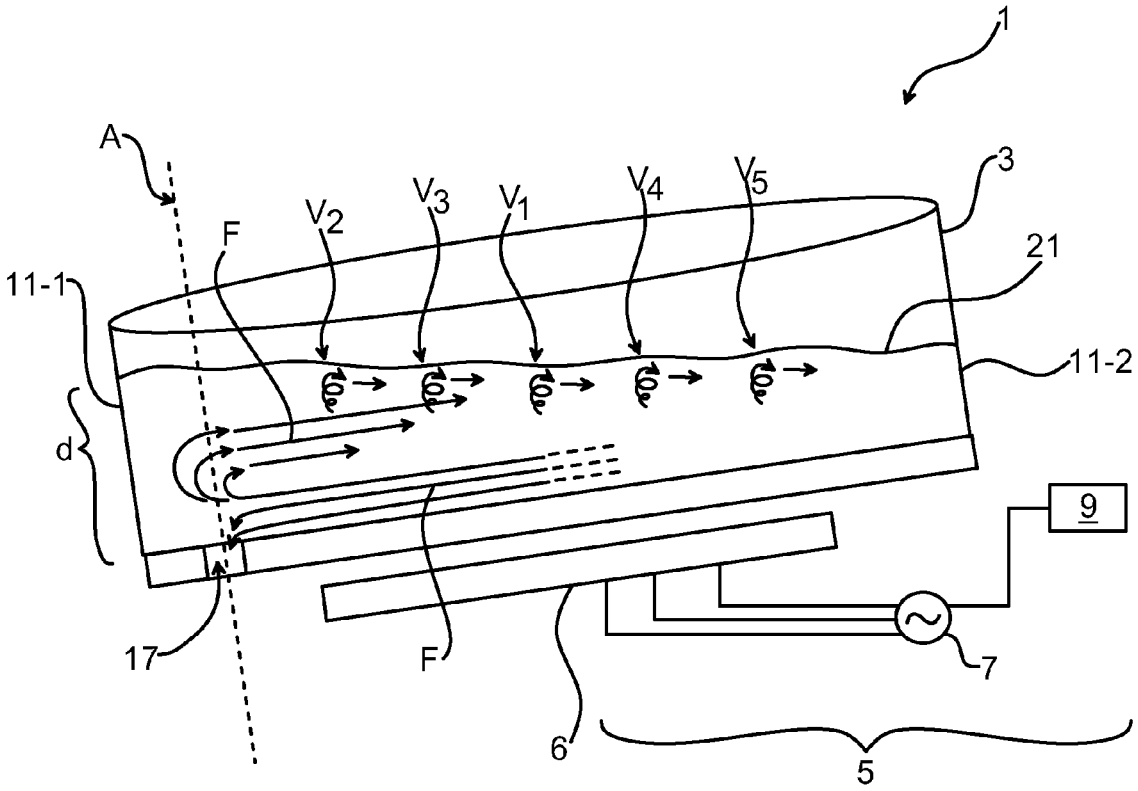
FIG. 3 is a schematic perspective view of the arrangement in FIG. 1 during tapping.

With reference to FIG. 3 a method of preventing or at least reducing the formation of the vortex $V_{tot}$ above the tapping hole 17 will now be described.

FIG. 3 shows the arrangement 1, which has already been described structurally in FIG. 1, during tapping. The metallurgical vessel 3 depicted in FIG. 3 contains molten metal 21 and the refractory material in the tapping hole 17 has been removed in order to allow tapping of the molten metal 21. Moreover, the metallurgical vessel 3 is slightly pivoted to facilitate tapping of the molten metal 21 through the tapping hole 17.

The control unit 9 controls the frequency converter 7 such that the electromagnetic stirrer 5 generates a time-varying electromagnetic field which is applied to the metallurgical vessel 3 and which generates a time-varying electromagnetic field in the molten metal 21. The time-varying electromagnetic field is preferably a linear electromagnetic field in the sense that it gives rise to a linear force in the molten metal. To this end the linear electromagnetic field affects essentially the entire molten metal in the metallurgical vessel, i.e. essentially the entire molten metal is moved in the metallurgical vessel by the linear force generated by the linear electromagnetic field. Hereto, the time-varying electromagnetic field in the molten metal provides a flow F of the molten metal 21 in the metallurgical vessel 3. The flow F is of a forced convection-type, circulating the molten metal 21 in the metallurgical vessel 3. In particular, the generated flow F is non-rotational and the flow F is transverse to, or crosses, the central axis A of the tapping opening 17 to thereby move the molten metal away from the central axis A along an upper portion of the depth d of the molten metal 21 while pushing the molten metal 21 which is close to the inner bottom surface 15 to discharge through the tapping hole 17. Thus, the flow F is such that the molten metal 21 flows towards the first inner wall portion of the metallurgical vessel 3 at the bottom 13 of the metallurgical vessel 3 and towards the second inner wall portion opposite the first inner wall portion at the surface of the molten metal 21. Any vortices V1, V2, V3, V4, and V5 formed in the volume of the molten metal 21 and moving towards the central axis A due to the tapping through the tapping hole 17 are hence constantly moved away from the central axis A, thereby preventing the accumulation of the vortices V1, V2, V3, V4, and V5 above the tapping hole around the central axis A and thus preventing the formation of an accumulated vortex such as vortex $V_{tot}$ of FIG. 2*b*.

The time-varying electromagnetic field generated in the molten metal 21 may be of such strength that a flow rate of the flow F of molten metal 21 is greater than 0.1 m/s. In one embodiment, the flow rate of the flow F of molten metal 21 may be in the range 0.1-0.7 m/s, and preferably in the range 0.1 m/s to below 0.7 m/s. In one embodiment the flow rate of the flow F of molten metal 21 may be in the range 0.1-0.6 m/s.

In one embodiment where the metallurgical vessel is an electric arc furnace, the time-varying electromagnetic field may have the same strength as when stirring the molten metal during meltdown. It is however preferred to generate a lower flow rate of the molten metal than when stirring the molten metal during meltdown.

The time-varying electromagnetic field to be generated by the electromagnetic stirrer 5 and applied to the metallurgical vessel 3 may be determined by empirical studies based on the type of metal to be melted, the shape and structure of the metallurgical vessel, the specific use of the metallurgical vessel e.g. as an electric arc furnace, tundish or ladle, or the specific compositions added to the metal during the meltdown, or a combination thereof. A control scheme most suitable for the specific application can thereby be determined and used in the control unit 9 for control of the frequency converter 7.

The time-varying electromagnetic field may continuously be applied to the metallurgical vessel 3 from meltdown to tapping, e.g. when the metallurgical vessel 3 is an electric arc furnace. In this case the strength of the time-varying electromagnetic field may be adjusted for the tapping, as has been described above. Alternatively, the time-varying electromagnetic field may be applied to the metallurgical vessel 3 essentially simultaneously as tapping of the molten metal 21 commences.

The inventive concept has mainly been described above with reference to a few embodiments. However, as is readily appreciated by a person skilled in the art, other embodiments than the ones disclosed above are equally possible within the scope of the inventive concept, as defined by the appended patent claims. For instance, the movement of the molten metal can be changed from a forward flowing direction to a backward flowing direction in the metallurgical vessel by modifying the time-varying electromagnetic field.

What is claimed is:

1. A method for reducing vortex formation in molten metal when bottom tapping the molten metal from a metallurgical vessel in a metal making process, wherein the method comprises:

tapping the molten metal via a tapping hole in the metallurgical vessel, and providing a flow of the molten metal in the metallurgical vessel while tapping by means of a time-varying electromagnetic field applied to the metallurgical vessel and provided by an electromagnetic stirrer, wherein the time-varying electromagnetic field provides a forced convection of the molten metal in the metallurgical vessel, and wherein the flow of the molten metal is such that the flow constantly moves vortices in the molten metal away from a tapping hole region of the metallurgical vessel and towards a wall of the metallurgical vessel to thereby prevent accumulation of the vortices and vortex formation over the tapping hole.

2. The method as claimed in claim 1, wherein the flow of the molten metal is in a direction transverse to a central axis of the tapping hole.

3. The method as claimed in claim 1, wherein the molten metal flows towards a first inner wall portion of the metallurgical vessel at the bottom of the metallurgical vessel and towards a second inner wall portion opposite the first inner wall portion at the surface of the molten metal.

4. The method as claimed in claim 1, wherein the time-varying electromagnetic field has such strength that a flow rate of the molten metal is in the range 0.1-1 m/s.

5. The method as claimed in claim 4, wherein the flow rate is in the range 0.1-0.6 m/s.

6. An arrangement for a metal making process, the arrangement comprising:

a metallurgical vessel for accommodating molten metal, the metallurgical vessel having a tapping hole for bottom tapping the molten metal from the metallurgical vessel, and an electromagnetic stirrer arranged to generate a time-varying electromagnetic field in molten metal arranged in the metallurgical vessel, wherein the electromagnetic stirrer comprises a coil arrangement, a frequency converter for operating the coil arrangement and a control unit for controlling the frequency converter such that the electromagnetic stirrer generates a time-varying electromagnetic field which is applied to the metallurgical vessel and which generates a time-varying electromagnetic field in the molten metal during tapping of the molten metal from the metallurgical vessel to thereby generate a flow of the molten metal in the metallurgical vessel, and wherein the time-varying electromagnetic field is such that it provides a forced convection of the molten metal in the metallurgical vessel such that the flow constantly moves vortices away from a tapping hole region and towards a wall of the metallurgical vessel during the tapping to thereby prevent accumulation of the vortices for vortex formation over the tapping hole.

7. The arrangement as claimed in claim 6, wherein the metallurgical vessel is an electric arc furnace.

8. The arrangement as claimed in claim 6, wherein the time-varying electromagnetic field is configured to generate a flow of the molten metal which is transverse to a central axis of the tapping hole.

9. The arrangement as claimed in claim 6, wherein the time-varying electromagnetic field is configured to generate a flow of the molten metal towards a first inner wall portion of the metallurgical vessel at the bottom of the metallurgical vessel and towards a second inner wall portion opposite the first inner wall portion at the surface of the molten metal.

10. The arrangement as claimed in claim 6, wherein the electromagnetic field is configured to generate a flow rate of the molten metal is-in the range 0.1-1 m/s.

11. The arrangement as claimed in claim 10, wherein the flow rate is in the range 0.1-0.6 m/s.

* * * * *